US006123245A

United States Patent [19]

Maltais

[11] Patent Number: 6,123,245

[45] Date of Patent: Sep. 26, 2000

[54] NAILER WITH NAIL GUIDING CHANNEL

[75] Inventor: Jacques Maltais, Beauport, Canada

[73] Assignee: Laboratoire Primatech Inc., Quebec, Canada

[21] Appl. No.: 09/293,155

[22] Filed: Apr. 16, 1999

[51] Int. Cl.[7] ..... B25C 1/04

[52] U.S. Cl. ..... 227/119; 227/120; 227/147

[58] Field of Search ..... 227/119, 120, 227/109, 147, 148, 136; 206/338

[56] References Cited

U.S. PATENT DOCUMENTS

| | | | |
|---|---|---|---|
| 2,994,878 | 8/1961 | Abrahamsen | 227/147 |
| 3,063,330 | 11/1962 | Dietrich . | |
| 3,980,179 | 9/1976 | Schrepferman . | |
| 4,285,456 | 8/1981 | Sheng-Wei . | |
| 4,375,867 | 3/1983 | Novak et al. | 227/109 |
| 4,693,407 | 9/1987 | Buck et al. | 227/109 |
| 5,074,453 | 12/1991 | Tachihara et al. | 227/119 |
| 5,288,004 | 2/1994 | Johnsson et al. | 227/120 |
| 5,522,533 | 6/1996 | Mukoyama et al. | 227/119 |

*Primary Examiner*—Scott A. Smith

*Attorney, Agent, or Firm*—F. Martineau

[57] ABSTRACT

The nailer has a horizontal nail magazine and an integral vertical column. The magazine horizontally feeds the nails through an inclined inlet port, into a vertical channel located in the column, and inside which is vertically slidable a selectively powered driver rod which hits and expels the nails through a nail outlet port. The vertical channel has a front and a rear wall adjacent the single nail located in the channel, and lateral walls. The inclined inlet port is located in the channel rear wall. When the driver rod is forcibly downwardly driven along the channel, it hits the upper inclined nail head with its flat lower abutment edge, thus gradually pivoting the nail into a vertical position as the nail is being driven towards the nailer outlet port. This results in the nail being pivoted from a position in which it is in transverse register with the inlet port, to a position in which it is in transverse register with the channel rear wall. Thus, the nail is prevented from transversely buckling upon the nail tip impacting with a hard surface at the nail outlet port, such as the head of another nail already driven into the surface being nailed. Indeed, the nail is transversely frontwardly supported by the channel front wall, and transversely rearwardly supported by the channel rear wall.

5 Claims, 3 Drawing Sheets

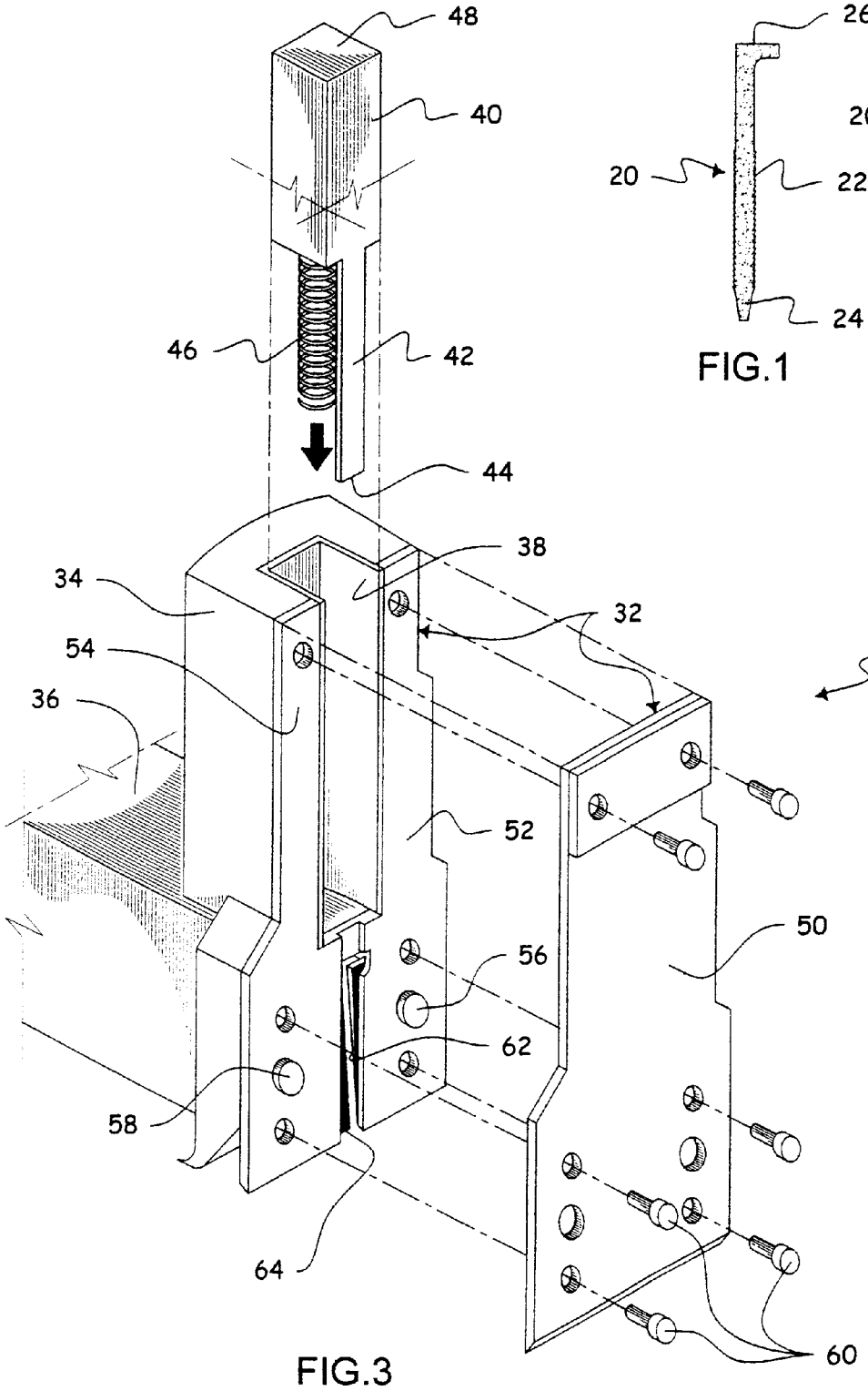
FIG.3
FIG.1
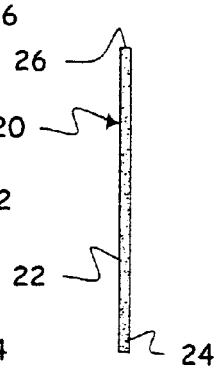
FIG.2

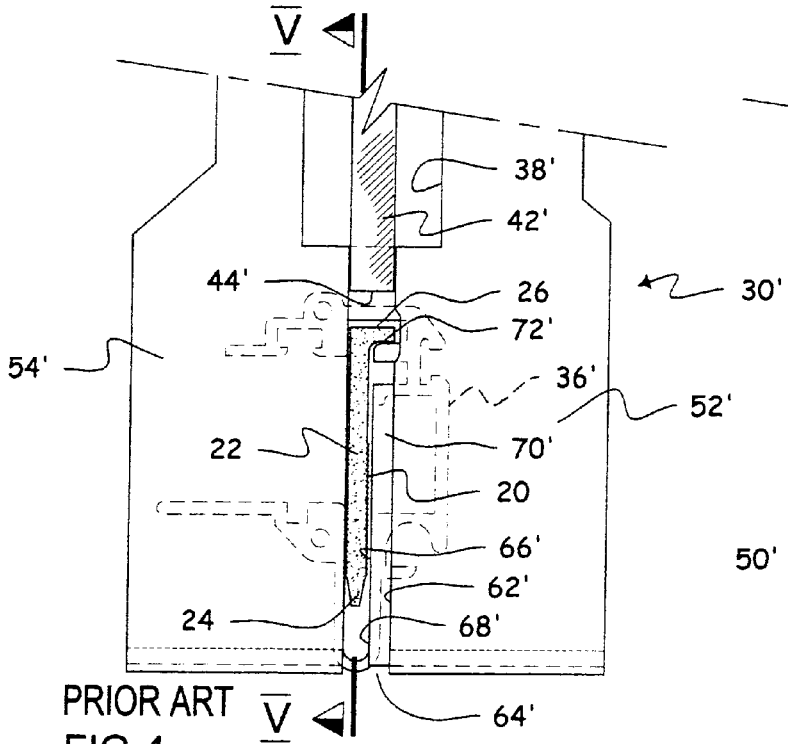
PRIOR ART
FIG.4
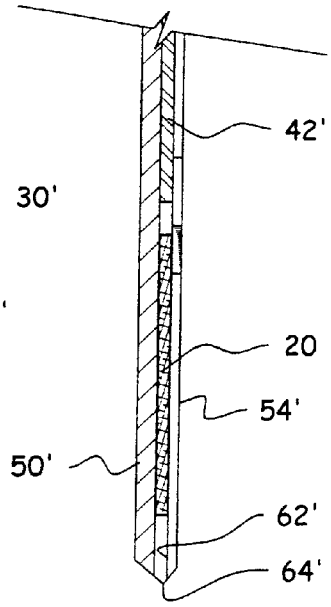
PRIOR ART
FIG.5
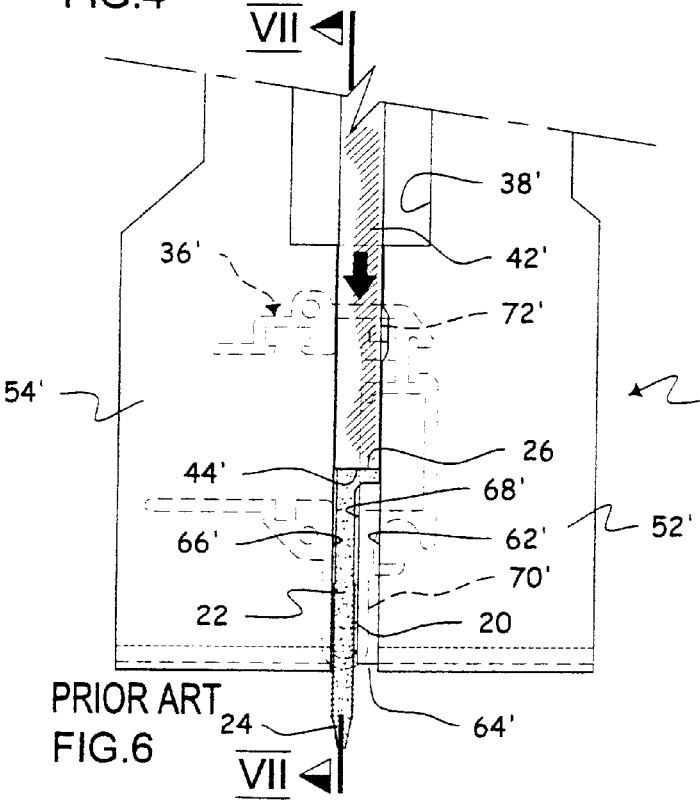
PRIOR ART
FIG.6
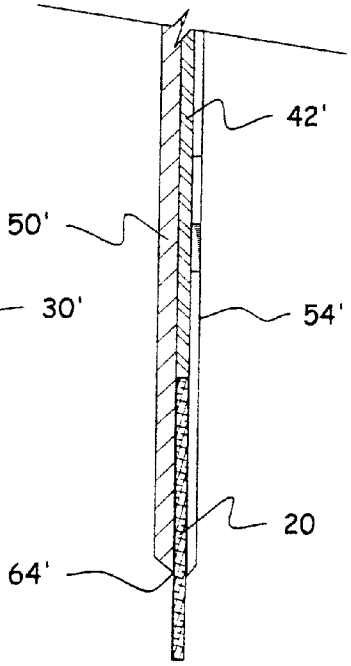
PRIOR ART FIG.7

NAILER WITH NAIL GUIDING CHANNEL

FIELD OF THE INVENTION

The present invention relates to nailers, and more particularly to a nailer with a nail guiding channel preventing accidental buckling of the nails.

BACKGROUND OF THE INVENTION

Nailers are used to forcibly drive nails through floor boards to be fixed to a subfloor, among other uses. A floor board nailer of known construction is a rigid hand tool adapted to assist workers with a hammer to drive the nails. The nailer comprises a main heavy rigid frame with an elongated nail-carrying magazine to be disposed horizontally against the floor. An upright rigid column vertically extends in register with the front end of the nail magazine, towards which spring-loaded nails are continuously biased in the magazine. The nails are serially linked to one another with a conventional frangible joint, wherein a single planar body is formed from a plurality of nails. When the frontmost edgewise nail is hit to be vertically downwardly driven into a floor board, the frangible joint attaching it to the remaining section of the planar integral body of nails will shearingly detach, allowing the nail to be released and expelled from the nailer. The frontmost nail is positioned in vertical downward register with a vertically spaced driving rod which can be forcibly hit, e.g. with a hammer, to drive the nail through the floor board. A spring returns the driving rod into its upper resting position, spacedly over the frontmost nail, so that it be ready to hit the next nail in the same manner. The frontmost nail is guided from the magazine through a horizontal feed channel into the vertical driving channel in which the driving rod vertically slides. The frontmost nail abuts onto a front plate and is thus positioned in the driving channel, ready to be hit by the driving rod.

The nails conventionally used have an inverted L-shape, i.e. they have an elongated body which tapers into a pointed tip at their lower end, and they are elbowed at their upper end to define a perpendicularly extending head portion which provides a hammering surface on which the driving rod is to hit the nail. The nails are transversely thinner, and thus are prone to possibly accidentally transversely buckle, with a concurrent plastic deformation, when driven towards the ground, if they accidentally hit a non-drivable hard ground surface, such as another nail head flatly registering with the floorboard. Since the frontmost nail frontwardly abuts against the rigid front plate, it is thus supported against accidental frontward transversal twisting. However, it is likely that the nail elongated body will tilt or twist transversely rearwardly, i.e. towards the magazine and against the other nails, under impact of the nail tip on a hard surface. Indeed, when the nail is being expelled, if the nail tip portion hits a particularly hard surface, such as the nail head of another nail already driven through a floor board, the nail tip may be prevented from piercing this underlying hard surface, and the nail may tilt or buckle under the overhead pressure exerted by the driver rod, with the nail body twisting transversely rearwardly through the horizontal feed channel and into the nail magazine against the bias of the spring-loaded nails. The nail may either twist with concurrent plastic deformation, or it may simply rearwardly tilt, into the nail magazine. This is of course highly undesirable, since it may result in the nail feed channel becoming obstructed by the twisted frontmost nail, in addition to the nail being uselessly spent.

OBJECTS OF THE INVENTION

It is an object of the invention to provide a more efficient nailer which helps prevent the nails from accidentally tilting or buckling inside the nailer when expelled from the nailer.

It is a carollary object of the invention that through use of this nailer, a substantially smaller amount of nails are spent because of accidentally incorrect orientation of the nailer relative to the wall to be nailed.

SUMMARY OF THE INVENTION

The present invention relates to nailers, and more specifically to a nailer with a nail guiding channel preventing accidental buckling of the nails.

More particularly, the present invention relates to a nailer for assisting a worker in forcibly driving a nail through and into a wall surface, the nail of the type having a substantially flat elongated body tapering to a pointed tip portion and being elbowed at an end portion thereof opposite its pointed tip to define a flat hammering head perpendicular to said nail elongated body, said nailer comprising:

- a main rigid body having a channel extending therethrough, said channel defining a first end, which corresponds to an outlet port through which the nail is to be expelled, and an opposite second end;
- a selectively powered driver rod having a flat abutment edge and movable through said main body channel from a resting position along a drive path into said channel for hitting and expelling the nail out through said outlet port; said driver rod abutment edge registering with said channel second end when said driver rod is at said resting position; said channel comprising front, rear and side walls, with said rear wall being provided with an inlet port intermediate said channel first and second ends, for allowing access of the nail into said nailer body channel, said inlet port having an angular offset relative to said drive path for feeding the nail in an inclined position inside said channel, and said rear wall defining an abutment rear wall portion located at least near said channel first end; and
- a biasing member carried by said nailer main body, for biasing the nail through said inlet port in an inclined fashion relative to said drive path corresponding to said inlet port angular offset, said biasing member temporarily maintaining the nail inside said channel through forcible abutment thereof against said channel front wall until the nail is expelled by said driver rod;

wherein upon said driver rod forcibly hitting the nail inside said channel, the nail will be gradually aligned along said drive path inside said channel by said flat driver rod abutment edge abutting against the nail flat head which is inclined relative to said flat driver rod abutment edge, said nail head acting as a lever to concurrently pivot the nail elongated body from a position in transverse register with said inlet port to a position at least in partial transverse register with said rear wall abutment portion while the nail tip portion is driven towards said channel first end, for preventing accidental rearwards tilting or buckling of the nail body into said inlet port when said nail tip portion reaches said outlet port.

Preferably, said channel rear wall comprises first and second spaced inverted triangular plates having respective inclined, spaced-apart, parallel inner edges between which said inlet port is defined, said first triangular plate forming said rear wall abutment portion and having a larger lower end portion near said channel first end and tapering towards said channel second end.

Preferably, said main body further carries a planar nail cartridge magazine extending transversely of said channel, said planar cartridge magazine having nail carrying rails which are inclined so as to incrementally feed the nails in an inclined position through said channel inlet port, said planar nail cartridge magazine carrying said biasing member for continuously biasing a planar nail cartridge made from serially linked nails attached to one another with frangible joints and having a frontmost nail to be biased into said channel for expelling the frontmost nail, said second triangular plate defining an upper shoulder on which the head portion of the rearwardly adjacent nail to the frontmost nail will rest, for allowing secure abutment of the rearwardly adjacent nail and concurrent shearing detachment of the frangible joint between the frontmost nail and the rearwardly adjacent nail upon the frontmost nail being hit by said driver rod.

The invention also relates to a nail guiding tool for assisting a worker with a hammer in manually driving a nail through and into a wall surface, said tool comprising:

a) a main rigid open frame having first and second open cavities, said first cavity having a base wall adjacent said second cavity with a notch transversely interconnecting said first and second cavities;

b) an elongated anvil member having a lenthwise axis, and defining a main body slidably mounted into said first cavity of said main rigid frame for slidable lengthwise movement therein between first and second positions, said anvil member main body defining at its outer end a head exposed exteriorly from said tool main frame to be axially impacted by the hammer, said anvil member further defining a finger lengthwisely projecting beyond said anvil member main body opposite said head and engaging said main frame notch and releasably engaging into said main frame second cavity;

c) a plate member integrally mounted to said tool main frame and partly enclosing said main frame second cavity, said plate member defining a straight through-channel defining a lengthwise axis and having an inner end coextensive to said notch and an opposite second end;

d) a nail magazine, anchored to said main frame and opening into said plate member through-channel, said nail magazine having a planar storage chamber for holding at least one nail and adapted to bring a nail within said through-channel, the plane of said planar nail storage chamber being angularly tilted relative to said lengthwise axis of said straight through-channel; and e) a ramp member, anchored to said plate member and extending between said through-channel and said planar storage chamber, said ramp member being slidingly engageable by said anvil finger; wherein upon a hammer blow being applied to said anvil head, said anvil member finger will hit the nail located in said through-channel to expel it out through said second cavity second end, said ramp member preventing accidental load-borne tilting or buckling of the thus ejected nail towards said nail storage chamber until the nail fully escapes said through-channel.

Preferably, the nail guiding tool further includes a biasing member engaging said anvil member and said tool main frame for biasing said anvil member away from said first cavity base wall and towards its said first position, wherein said biasing member automatically returns said anvil member back to said first position thereof after the hammer has impacted said anvil member head and after said anvil member finger has fully engaged said second cavity.

DESCRIPTION OF THE DRAWINGS

In the annexed drawings:

FIGS. 1 and 2 are respectively a front elevation and an edge view of a conventional nail used in nailers;

FIG. 3 is a partial perspective exploded view of the nailer according to the invention;

FIG. 4 is a partial front elevation of the lower front portion of a prior art nailer, with the front plate removed for clarity of the drawing, and with the nail magazine being shown in dotted lines, and further showing a nail engaging the vertical driving channel of the nailer;

FIG. 5 is a cross-sectional view taken along line V—V of FIG. 4, with the front plate being additionally shown;

FIG. 6 is similar to FIG. 4, but shows the frontmost nail being driven downwardly towards the nail outlet port, with the lower tip portion of the nail protruding out of the nailer;

FIG. 7 is a cross-sectional view taken along line VII—VII of FIG. 6, with the front plate being additionally shown;

DETAILED DESCRIPTION OF THE EMBODIMENTS

Figure 8:
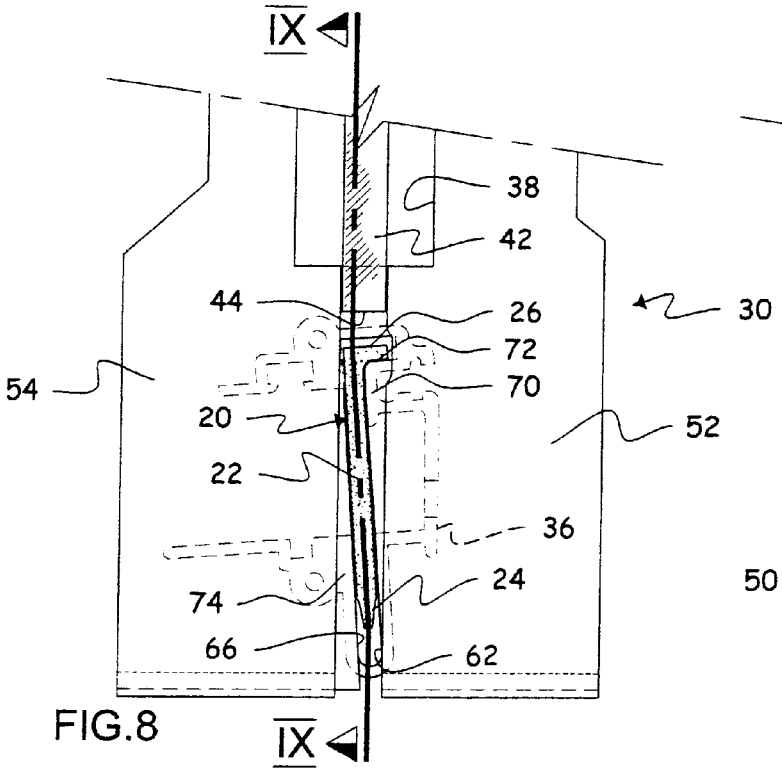
FIG. 8 is a partial front elevation of the lower front portion of the nailer according to the present invention, with the front plate removed for clarity of the drawing, and with the nail magazine being shown in dotted lines, and further showing a nail engaging the vertical driving channel of the nailer.
Figure 9:
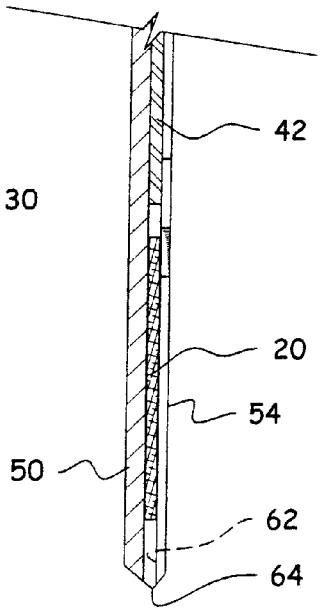
FIG. 9 is a cross-sectional view taken along line IX—IX of FIG. 8, with the front plate being additionally shown.

FIGS. 1 and 2 show a nail 20 conventionally used in nailers of the type described in the Background of the Invention section and which is used with the nailer of the present invention. In front elevation, as shown in FIG. 1, nail 20 has an elongated body 22 which tapers to a pointed tip portion 24, and has a flat head 26 at an elbowed end portion of the nail body 22, opposite the pointed tip portion 24. Elbowed head 26 must be preferably perpendicular to the elongated body 22, for best performance. More particularly, nail 20 is elbowed at its upper end portion to form the perpendicularly extending flat head 26, nail 20 thus generally being L-shaped.

It can further be seen that nail 20 has a generally flat body 22, and is transversely much thinner in edge view, as shown in FIG. 2, than in the front elevation of FIG. 1. Thus, under an impacting load hitting the nail head 26, nail 20 is inherently prone to transversely buckle if its tip portion 24 is propelled towards and against a very hard surface, such as the head of another nail already driven in a floor board, as explained in the Background of the Invention section.

A number of nails 20 can be serially linked by flatly successively abutting the nails on their flat surfaces and attaching them by means of known frangible joints (not shown), to form a planar nail cartridge (not shown) of known configuration. The nail cartridge made from a plurality of such L-shaped nails can be loaded into a nailer, for allowing the nails to be successively detached and used one at a time.

FIG. 3 shows a nailer 30 according to the invention, comprising a main rigid frame body 32 having an upright column 34 and a transverse, rearwardly extending nail magazine 36. A handle (not shown) is fixed over and outwardly of magazine 36, for manually carrying nailer 30 spacedly over ground, and for securely holding nailer 30 against the surface to be nailed. Column 34 has a vertical chimney 38 therein, in which is vertically slidable an actuator 40 carrying a downwardly-depending flat driver rod 42 defining a horizontally flat, lower abutment edge 44. Actuator 40 is further provided with a coil spring 46 which abuts and is attached at the chimney 38 lower end, spring 46 biasing actuator 40 towards an upper resting position. A guiding pole (not shown) is preferably provided coaxially inside coil spring 46, being attached at the lower end of chimney 38, and axially engaging a complementary vertical hole extending inside actuator 40, for guiding actuator 40 in its downward sliding displacement. Upon hitting the upper heel 48 of actuator 40 with a hammer or other suitable device, actuator 40 will be suddenly forcibly downwardly displaced against the bias of spring 46, but at the end of its outward motion, it will move back and it will retrieve its upper resting position under the bias of spring 46 after the blow has been dealt.

The front portion of nailer 30 comprises a front plate 50 and a pair of intermediate lateral plates 52, 54, all attached to the nailer column 34 by means of guiding pins 56, 58 and bolts 60. Although the inner surface of front plate 50 is concealed in FIG. 3, it is understood that it is flat. Lateral plates 52, 54 are shaped and spaced to conform to the chimney opening 38 at their upper portion, and to form a narrower vertical channel 62 at their lower portion, wherein driver rod 42 is slidingly engageable. At the bottom of channel 62 is defined an outlet port 64, through which the nails are to be expelled, as will be detailed hereinafter.

All the elements described up to now are as in the prior art devices, and are thus of known construction, except for the portions of lateral plates 52, 54 which form channel 62, as will be explained hereinafter. However, for clarity purposes, a known prior art device will now be described, reference being made to FIGS. 4–7, wherein the lower front portion of a prior art nailer 30' is shown, which is similar is many respects to nailer 30. For clarity of the drawings, the front plate 50' of the prior art nailer has been removed in FIGS. 4 and 6.

FIGS. 4 and 6 sequentially show a nail being expelled out from nailer 30'. The nail magazine 36' of nailer 30' comprises an inner guiding rail 66' along which the nails are guided towards a nail inlet port 68' which provides access from nail magazine 36' to channel 62' for the nails. Thus, a planar nail cartridge as described hereinabove can be loaded into guiding rails 66' of magazine 36'. The nail cartridge is spring loaded inside magazine 36', so that the nails be continuously biased towards channel 62', with the frontmost nail 20 (shown in FIGS. 4–7) being biased through inlet port 68' and into channel 62', and abutting against front plate 50', as shown in FIG. 5. The frontmost nail 20 is vertically supported by its frangible joint attachment to the rearwardly adjacent nail (not shown) of the nail cartridge located in the magazine 36'. If the nail 20 located in channel 62' is the last nail of the remaining planar nail cartridge section, it is then vertically supported by its frictional engagement between the conventional biasing member (not shown) carried by magazine 36' and front plate 50'. The conventional biasing member comprises a spring-loaded carriage slidable in the magazine rail 66', which forcibly abuts on the last nail of the nail cartridge and thus biases the serially linked nails of the cartridge towards channel 62'.

Channel 62' is thus formed by a front wall which is the front plate 50', two lateral walls which are the inner edges of lateral plates 52', 54', and a rear wall, which is formed by a short plate extension 70' which is integrally attached to lateral plate 52', but which is much thinner than the latter. Plate extension 70' is thin enough to be rearwardly positioned relative to channel 62', and consequently does not hamper the vertical sliding engagement of nail 20 and of driver rod 42' in channel 62'.

Inlet port 68' is defined between plate extension 70' and the opposite lateral plate 54'; that is to say, the nail body 22 can be transversely biased into channel 62' through inlet port 68', between the spaced-apart lateral plate 54' and extension plate 70'. Plate 70' upwardly extends short of the full length of inlet port 68', defining an upper shoulder 72' upon which the head of the rearwardly adjacent nail will abut when the frontmost nail 20 is located in channel 62'. Thus, inlet port 68' is shaped in a complementary fashion to nail 20, i.e. that it has an inverted L-shape.

In use, the frontmost nail 20 of the nail cartridge is initially located and positioned as shown in FIGS. 4 and 5, i.e. frontwardly biased into abutment against front plate 50' and vertically positioned spacedly under driver rod 42' and spacedly over outlet port 64', inside channel 62'. Upon forcibly hitting the heel 48 of the actuator 40 (not shown in the prior art device, but identical to the corresponding parts of the nailer 30 of FIG. 3), driver rod 42' is downwardly driven and flatly impacts with its flat lower abutment edge 44' the flat head 26 of nail 20, for downwardly driving nail 20, as shown in FIGS. 6 and 7. Since the rearwardly adjacent nail to frontmost nail 20 downwardly rests with its head 26 on shoulder 72', it will not be downwardly carried with the frontmost nail 20, the frangible joint between the two nails being ruptured upon impact from driver rod 42' on the frontmost nail 20.

When the nail 20 is being expelled, if the frontmost nail tip portion 24 hits a particularly hard surface, such as the nail head of another nail already driven into a floor board, the nail tip 24 may be prevented from piercing this underlying hard surface, and the nail 20 may buckle under the overhead pressure exerted by rod 42', with the nail body 22 twisting transversely rearwardly through inlet port 68' and into the nail magazine 66' against the bias of the spring-loaded nail cartridge. This is of course highly undesirable, since it may result in the nail inlet port 68' becoming obstructed and jammed by the twisted frontmost nail 20, in addition to the nail 20 being uselessly spent, and the nailer tool therefore becoming inoperative with removal of the deformed obstructing nail being a difficult endeavour.

Alternately, upon the nail 20 being expelled out through outlet port 64', the nail tip portion 24 may tilt rearwardly through inlet port 68' against the bias of the biased nail cartridge, without buckling or any other plastic deformation, upon the nail tip 24 hitting a particularly hard surface. Again, this is highly undesirable, since the nail 20 would effectively obstruct the nail inlet port 68'.

FIGS. 8–11 show the front portion of the nailer 30 according to the present invention, which is similar to the front portion of prior art nailer 30', except as noted hereinafter.

Figure 10:
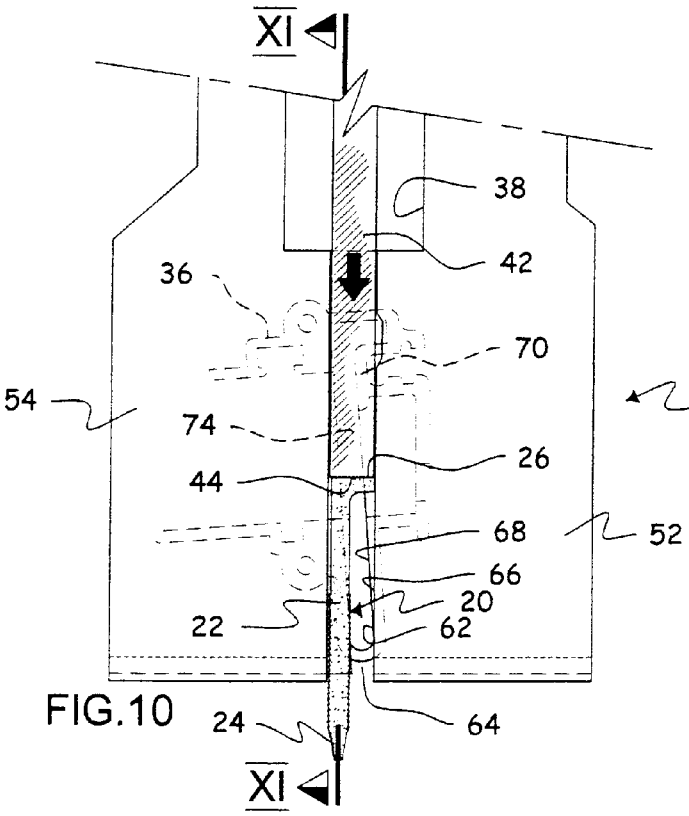
FIG. 10 is similar to FIG. 8, but shows the frontmost nail being driven downwardly towards the nail outlet, with the lower tip portion of the nail protruding out of the nailer.
Figure 11:
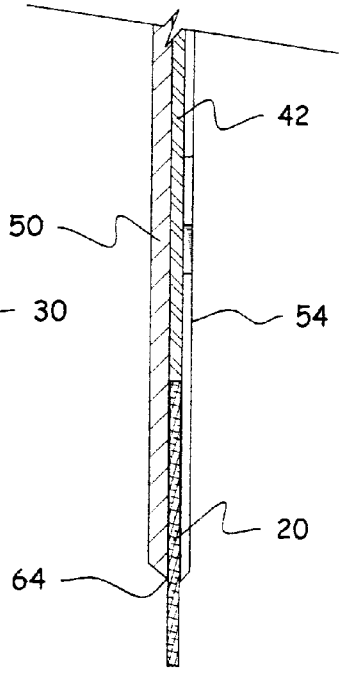
FIG. 11 is a cross-sectional view taken along line XI—XI of FIG. 10, with the front plate being additionally shown.

As seen in FIGS. 8 and 10, the nail magazine 36, and also the nail guiding rail 66, have a slight angular offset, relative to the downward drive path of the driver rod 42. Correspondingly, inlet port 68 is also laterally tilted. Thus, the nails are fed into channel 62 in an inclined fashion, relative to the driver rod drive path. A first triangular plate extension 70 integrally inwardly extends from lateral plate 52, and tapers towards the lower end of channel 62 to accommodate the tilted position of the nail 20 which is biased through inlet port 68 into channel 62 in this tilted position. Plate extension 70 upwardly extends short of the full length of inlet port 68, and defines a slightly inclined shoulder 72, on which the inclined head of the rearwardly adjacent nail (not shown) to the frontmost nail 20, flatly abuts.

A second triangular abutment plate 74 integrally inwardly extends from the second lateral plate 54, and has a larger area near the lower end of channel 62, near the outlet port 64, and tapers towards the upper end of channel 62. Abutment plates 70 and 74 are thinner than lateral plates 52 and 54, and are located rearwardly of channel 62 to define the rear wall thereof. The inner edges of plates 70, 74 are parallel to each other, and inlet port 68 is defined between these two spaced parallel plate edges. Inlet port 68 further extends over the shoulder 72 of extension plate 70, to allow passage of the nail head 26 from nail magazine 36 into channel 62.

In use, upon downward displacement of driver rod 42 along its downward vertical drive path, driver rod 42 hits with its flat horizontal lower abutment surface 44 the inclined upper head 26 of the frontmost nail 20. Due to the upwardly inclined position of the flat nail head 26, nail 20 will be brought into gradual pivotal motion during the downward movement of rod 42 and its inclined position will be gradually rectified into a vertical position, aligned with the driver rod drive path, as suggested in figure 10. Indeed, the perpendicular nail head 26 will act as a lever to impart the pivotal displacement of nail 20 upon rod 42 vertically downwardly impacting with the inclined nail head 26. The nail body 22 flat lateral edge, opposite the laterally-extending head 26, will be gradually pivoted into a flat sliding abutment against the inner edge of lateral plate 54, as shown in FIG. 10.

When the nail tip portion 24 reaches the outlet port 64, nail 20 is aligned with the vertical driver rod drive path, and the nail tip portion 24 is then in transverse register with the rearwardly positioned abutment plate 74. In fact, most of the nail body 22 will also be in transverse register with the abutment plate 74. Thus, if the nail tip portion impacts against a particularly hard surface, such as the nail head of another nail already driven through a floor board, the nail 20 will not be prone to transversely tilt or buckle rearwardly into the nail inlet port 68, due to the rearwardly supporting abutment plate 74.

Nail 20 is thus supported against tilting or buckling in both of its structurally weaker directions, i.e. it is supported against accidental rearwards transversal twisting by the rear abutment plate 74, and against accidental frontwards transversal twisting by front plate 50. Undesirable accidental obstruction (jamming) of the nail inlet port by a nail is thus prevented.

Therefore, instead of buckling or tilting into the nail inlet port 68 when impacting with its lower tip 24 on a hard surface, the nail 20 is likely to be deflected by the hard surface to a softer surface adjacent thereto, and still be expelled from the nailer. In the case where the nail would still accidentally twist, it is likely to twist outwardly of channel 62; this would be without dire consequences, since the nail would not obstruct the nail inlet port 68, and thus could simply be manually removed.

It is understood that the nailer 30 of the present invention has been described for nailing floor boards to a subfloor, but it could be used to nail any suitable wall surface.

Also, the nailer 30 has been shown with a nail-driving anvil member or actuator 40, although it is understood that the driver rod 42 could be propelled with any selectively actuated power means, such as a known hydraulic power device, for example.

The nailer head or heel portion 48 also preferably comprises a ring having a larger diameter than actuator 40, this ring coming into downward vertical abutment with the upper surface of the upright column of nailer 30, to limit actuator 40 to a downward limit position.

Any other modifications, which do not deviate from the scope of the present invention, are considered to be included therein.

I claim:

1. A nailer for assisting a worker in forcibly driving a nail through and into a wall surface, the nail of the type having a substantially flat elongated body tapering to a pointed tip portion and being elbowed at an end portion thereof opposite its pointed tip to define a flat hammering head perpendicular to said nail elongated body, said nailer comprising:

a main rigid body having a channel extending therethrough, said channel defining a first end, which corresponds to an outlet port through which the nail is to be expelled, and an opposite second end;

a selectively powered driver rod having a flat abutment edge and movable through said main body channel from a resting position along a drive path into said channel for hitting and expelling the nail out through said outlet port; said driver rod abutment edge registering with said channel second end when said driver rod is at said resting position; said channel comprising front, rear and side walls, with said rear wall being provided with an inlet port intermediate said channel first and second ends, for allowing access of the nail into said nailer body channel, said inlet port having an angular offset relative to said drive path for feeding the nail in an inclined position inside said channel, and said rear wall defining an abutment rear wall portion located at least near said channel first end; and a biasing member carried by said nailer main body, for biasing the nail through said inlet port in an inclined fashion relative to said drive path corresponding to said inlet port angular offset, said biasing member temporarily maintaining the nail inside said channel through forcible abutment thereof against said channel front wall until the nail is expelled by said driver rod;

wherein upon said driver rod forcibly hitting the nail inside said channel, the nail will be gradually aligned along said drive path inside said channel by said flat driver rod abutment edge abutting against the nail flat head which is inclined relative to said flat driver rod abutment edge, said nail head acting as a lever to concurrently pivot the nail elongated body from a position in transverse register with said inlet port to a position at least in partial transverse register with said rear wall abutment portion while the nail tip portion is driven towards said channel first end, for preventing accidental rearwards tilting or buckling of the nail body into said inlet port when said nail tip portion reaches said outlet port.

2. A nailer as defined in claim 1, wherein said channel rear wall comprises first and second spaced inverted triangular plates having respective inclined, spaced-apart, parallel inner edges between which said inlet port is defined, said first triangular plate forming said rear wall abutment portion and having a larger lower end portion near said channel first end and tapering towards said channel second end.

3. A nailer as defined in claim 2, wherein said main body further carries a planar nail cartridge magazine extending transversely of said channel, said planar cartridge magazine having nail carrying rails which are inclined so as to incrementally feed the nails in an inclined position through said channel inlet port, said planar nail cartridge magazine carrying said biasing member for continuously biasing a planar nail cartridge made from serially linked nails attached to one another with frangible joints and having a frontmost nail to be biased into said channel for expelling the frontmost nail, said second triangular plate defining an upper shoulder on which the head portion of the rearwardly adjacent nail to the frontmost nail will rest, for allowing secure abutment of the rearwardly adjacent nail and concurrent shearing detachment of the frangible joint between the frontmost nail and the rearwardly adjacent nail upon the frontmost nail being hit by said driver rod.

4. A nail guiding tool for assisting a worker with a hammer in manually driving a nail through and into a wall surface, said tool comprising:

a) a main rigid open frame having first and second open cavities, said first cavity having a base wall adjacent said second cavity with a notch transversely interconnecting said first and second cavities;

b) an elongated anvil member having a lengthwise axis, and defining a main body slidably mounted into said first cavity of said main rigid frame for slidable lenthwise movement therein between first and second positions, said anvil member main body defining at its outer end a head exposed exteriorly from said tool main frame to be axially impacted by the hammer, said anvil member further defining a finger lengthwisely projecting beyond said anvil member main body opposite said head and engaging said main frame notch and releasably engaging into said main frame second cavity;

c) a plate member integrally mounted to said tool main frame and partly enclosing said main frame second cavity, said plate member defining a straight through-channel defining a lengthwise axis and having an inner end coextensive to said notch and an opposite second end;

d) a nail magazine, anchored to said main frame and opening into said plate member through-channel, said nail magazine having a planar storage chamber for holding at least one nail and adapted to bring a nail within said through-channel, the plane of said planar nail storage chamber being angularly tilted relative to said lengthwise axis of said straight through-channel; and e) a ramp member, anchored to said plate member and extending between said through-channel and said planar storage chamber, said ramp member being slidingly engageable by said anvil finger; wherein upon a hammer blow being applied to said anvil head, said anvil member finger will hit the nail located in said through-channel to expel it out through said second cavity second end, said ramp member preventing accidental load-borne tilting or buckling of the thus ejecting nail towards said nail storage chamber until the nail fully escapes said through-channel.

5. A nail guiding tool as in claim 4, further including a biasing member engaging said anvil member and said tool main frame for biasing said anvil member away from said first cavity base wall and towards its said first position, wherein said biasing member automatically returns said anvil member back to said first position thereof after the hammer has impacted said anvil member head and after said anvil member finger has fully engaged said second cavity.

* * * * *